United States Patent [19]

Tarumi et al.

[11] 4,425,035

[45] Jan. 10, 1984

[54] IMAGE REPRODUCING APPARATUS

[75] Inventors: Noriyoshi Tarumi, Hachioji; Haruo Iwahashi, Fussa; Masahiko Matsunawa; Hiroshi Tokunaga, both of Hachioji, all of Japan

[73] Assignee: Konishiroku Photo Industry Co., Ltd., Tokyo, Japan

[21] Appl. No.: 268,795

[22] Filed: Jun. 1, 1981

[30] Foreign Application Priority Data

Jun. 11, 1980 [JP] Japan ..... 55/82173[U]

[51] Int. Cl.[3] ..... G03G 15/02; H01T 19/04

[52] U.S. Cl. ..... 355/3 CH; 250/324; 250/325; 355/14 CH; 361/235

[58] Field of Search ..... 355/3 R, 3 CH, 14 CH; 361/235; 250/324, 325, 326, 503.1; 505.1

[56] References Cited

U.S. PATENT DOCUMENTS 4,088,891 5/1978 Smith et al. ..... 250/324
4,123,156 10/1978 Inowa et al. ..... 355/3 CH X
4,153,836 5/1979 Simm ..... 250/325
4,168,973 9/1979 Simm et al. ..... 250/325 X

*Primary Examiner*—Fred L. Braun
*Attorney, Agent, or Firm*—Jordan B. Bierman; Linda Bierman

[57] ABSTRACT

An image reproducing apparatus includes an ion modulating electrode and a device for imparting oscillation thereto. The ion modulating electrode is formed of a continuous layer of conductive material, a segmented layer of conductive material, an insulating layer interposed between the continuous and segmented layers, and at least a row of apertures for modulating ion flow generated by a charge generator. At least one embodiment of the device for imparting oscillation includes a rotor or cam rotatable to apply oscillation to a receiving plate. In another embodiment, the oscillation imparting device is formed of a permanent magnet, a coil placed in the magnetic field generated by the magnet, an oscillator for applying an alternating current to the coil and an oscillation element connected to the coil.

8 Claims, 5 Drawing Figures

IMAGE REPRODUCING APPARATUS

BACKGROUND OF THE INVENTION

1. Field of the Invention

This invention relates to an image reproducing apparatus which forms an electrostatic image, such as an electrostatic latent image and charged toner image, on a charge receptor by controlling an ion flow from a charge generator to the charge receptor by use of an ion modulating electrode having apertures.

2. Description of the Prior Art

Multi-stylus electrodes have primarily been employed as means for reproducing an electrostatic image on a charge receptor, but this method is not much preferable because there is an inevitable limitation to the quality of the reproducing image. On the other hand, as one of the methods using an ion modulating electrode, there is a device which puts on ion flow on ink mist to directly form a visible image on a charge receptor. To increase the recording speed, however, the area of apertures of the ion modulating electrode must be increased so that expansion of the ink mist occurs, the result being the quality problem of the image in the same way as in the abovementioned method.

SUMMARY OF THE INVENTION

The present invention relates to an image reproducing apparatus characterized by use of an improved ion modulating electrode as an improvement over the conventional ion modulating electrode for the purpose of modulating the ion flow. In the image reproducing apparatus of the present invention, too, when an ion flows through apertures dust and developers floating in the air are likely to be ionized, deposite on the apertures of the ion modulating electrode and eventually exert adverse influences on the ion flow and deteriorate the quality of the forming electrostatic image.

It is therefore an object of the present invention to provide an image reproducing apparatus which is capable of reproducing a high quality image by modulating the ion flow by use of an ion modulating electrode.

It is further object of the present invention to provide an image reproducing apparatus which comprises; a charge generator, an ion modulating electrode having at least a row of aperture for modulating ion flow generated by said charge generator, a charge receptor for reproducing an electrostatic image by the modulated ion flow, and a means for imparting oscillation to said ion modulating electrode.

These and other objects and features of the present invention will become more apparent from the following description to be read in conjunction with the accompanying drawings.

DESCRIPTION OF THE PREFERRED EMBODIMENTS

Figure 1:
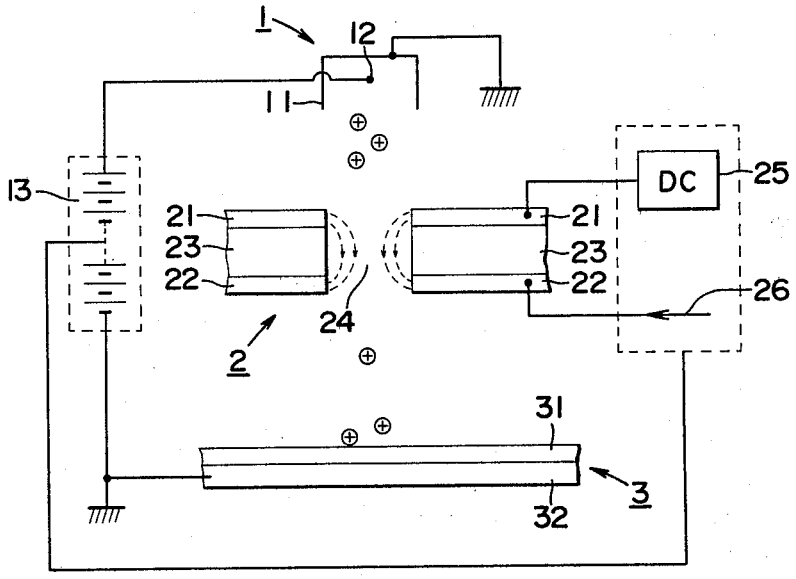
PRIOR ART FIG. 1
FIG. 1 is a general view showing the disposition of components forming the construction of an image reproducing apparatus having an ion modulating electrode.

The construction and action of the ion modulating electrode of the image reproducing apparatus will be first described with reference to FIG. 1 which is a general view of the apparatus having the ion modulating electrode. In the drawing, reference numeral 1 represents a charge generator which includes a corona wire 12 inside an earth plate 11. A tungsten wire having a diameter of 40 to 100 μm is generally used as the corona wire. Reference numeral 2 represents the ion modulating electrode having the construction in which an insulating layer 23 is interposed between a continuous layer of conductive material 21 and a segmented layer of conductive material 22. An aperture 24 of the ion modulating electrode 2 is placed immediately below the corona wire 12.

A conductive member of a metal such as copper or aluminum is generally used for the layers 21 and 22 that consist of the continuous layer of the conductive material and the segmented layer of the conductive material, respectively. Though the insulating layer 23 may be an air layer, it is generally made of an insulating high molecular material such as a polyimide film or a polyester film.

In order to effectively apply the ion flow to the charge receptor, the thickness of each of the layers 21, 22 and insulating layer 23 is preferably thin. Generally, the thickness is up to 100 μm for each layer 21,22 and is up to 200 μm for the insulating layer 23.

The charge receptor 3 consists of a dielectric layer 31 and a conductive layer 32, and a positive high voltage is applied between the corona wire 12 and the conductive layer 32 from a high voltage power source 13. The ion modulating electrode 2 is disposed between the charge generator 1 and the charge receptor 3. The electrostatic latent image formed on this charge receptor is developed by known particles called "toner" into a visible image and is thereafter either fixed as such into a permanent image or is transferred to other recording members, whereby the charge receptor 3 is available for re-use. The continuous layer 21 of the ion modulating electrode 2 is positioned on the side of the charge generator 1, is connected to a DC power source 25 and is applied with a DC bias. On the other hand, a voltage signal 26 on the basis of image information is applied to the segmented layer 22, defines electric apertures in the apertures 24 by means of a potential difference between it and the continuous layer 21 and either enhances or blocks the passage of the ion flows that flows from the charge generator 1 to the charge receptor 3.

The DC power source 25 and the voltage signal 26 are held at a high potential (500–3000 V) with respect to the conductive layer 32 of the charge receptor 3 in order to effectively guide the ion flow to the charge receptor 3.

Figure 2:
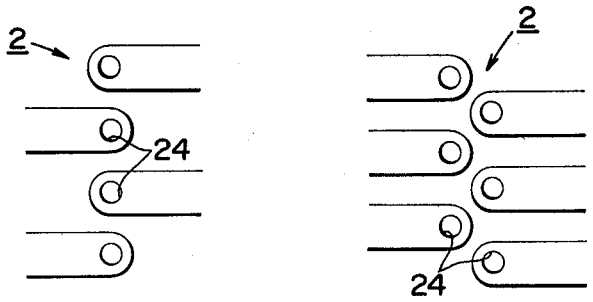
PRIOR ART FIG. 2
FIG. 2 is a schematic view showing the arrangement of the ion modulating electrode in the above-mentioned apparatus.

One or plural lines of apertures 24, that are electrically divided from one another, are formed on the ion modulating electrode 2 as shown in FIG. 2. The ion flow passes through the apertures 24 and forms an electrostatic latent image on the dielectric layer 31 of the charge receptor 3. The apertures 24 are bored by laser beam work or chemical etching work. It is generally believed preferable that the pitch of the apertures 24 is from 50 to 500 meshes and the ratio of apertures is at least 30%. Resolution of the image to be formed is determined by the diameter and pitch of these apertures 24. This resolution of the image can be confirmed by developing the electrostatic latent image formed on the dielectric layer 31 by use of a developer consisting of known coloring particles thereby to visualize the latent image and by transferring the developed image, if necessary, onto transfer paper into a visual image.

As described above, it is the major premise that the ion modulating electrode 2 having the fine, well-worked apertures 24 be employed in order to form an image having high resolution. When the ion flow passes through these fine apertures 24 having a diameter as small as up to 50 μm, ionized micro-fine dust and developer deposite so that they never fail to exert influences upon the ion flow and cause degradation of the quality of the forming image.

Accordingly, the improved image reproducing apparatus in accordance with the present invention will now be described in detail with reference to embodiments thereof shown in the drawing.

Figure 3:
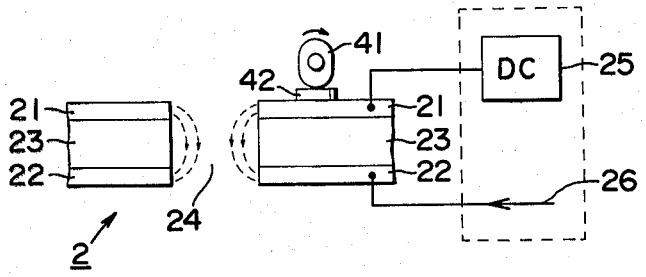
FIGS. 3(*a*) through 3(*c*) are schematic views, each showing the construction of the ion modulating electrode in the apparatus of the present invention.
Figure 3:
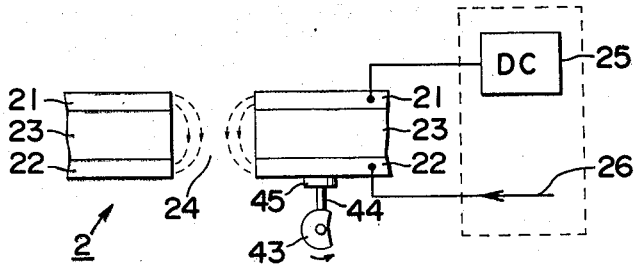
Figure 3:
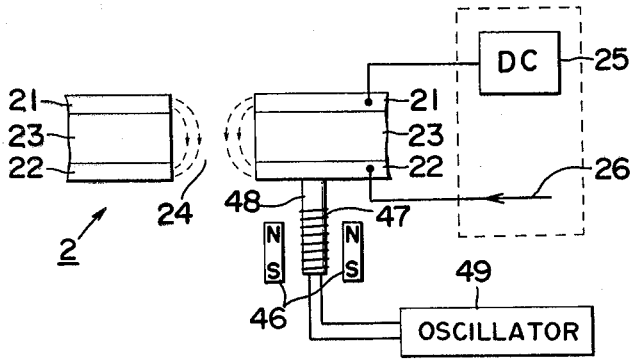

FIG. 3 is a schematic view of the construction of the ion modulating electrode in the improved image reproducing apparatus of the present invention.

Referring initially to FIG. 3(*a*), a rotor 41 and an oscillation receiving plate 42 are disposed as members that impart oscillation to the ion modulating electrode. Using the peculiar shape of the rotor 41, the rotor is rotated by a driving source (not shown) to generate motion in the vertical direction, and oscillation in the vertical direction (as viewed in the drawing) is transmitted to the ion modulating electrode 2 through the oscillation receiving plate 42. In this case, it is preferred that the oscillation receiving plate 42 be made of an insulating material such as a thin plastic sheet. Any materials can be used for the rotor 41 so long as they are abrasion-resistant.

FIG. 3(*b*) shows another construction in which a cam 43 and an oscillation element 44 are used in place of the rotor 41 of FIG. 3(*a*), and reference numeral 45 represents the oscillation receiving plate. The oscillation element 44 in this case is an essential member for transmitting its vertical motion due to rotation of the cam 43, to the ion modulating electrode 2 via the oscillation receiving plate 45 with a higher level of fidelity.

FIG. 3(*c*) shows an example of a device which electrically imparts oscillation to the ion modulating electrode 2.

In this drawing, reference numeral 46 represents a permanent magnet; 47 is a coil; 48 is an oscillation element; and 49 is an oscillator. In the device of this embodiment, an alternating current is generated by the oscillator 49 and passed through the coil 47 placed in the magnetic field generated by the permanent magnet 46 and a force acts upon the coil 47 and causes motion in the vertical direction. The motion can be allowed to act upon the ion modulating electrode as the vertical oscillation through the oscillation element 48. The foregoing embodiments deal with the case in which oscillation occurs in the vertical direction, but it goes without special noting that oscillation may occur to the right and left.

As described in detail in the foregoing, in the apparatus of the present invention, the member for imparting oscillation to the ion modulating electrode is so disposed as to mechanically or electrically impart oscillation to the ion modulating electrode. According to this arrangement, it becomes possible to prevent in advance deposition of the dust or developer on the apertures of the ion modulating electrode, which dust occurs when the ion flow is caused to flow towards the charge receptor through the apertures of the ion modulating electrode. Since the ion flow is allowed to flow constantly stably to the charge receptor, it becomes possible to prevent occurrence of degradation of the image quality and to obtain an image having high resolution. Though the present invention imparts oscillation to the ion modulating electrode in the above-mentioned manner, the timing for imparting oscillation is optional. However, if oscillation is imparted at the time of image formation, disturbance of the image would occur. For this reason, it is preferred that oscillation be imparted at the time not forming the electrostatic image on the charge receptor.

Incidentally, it is also possible to conjointly use means for applying an AC voltage to the ion modulating electrode and simultaneously feeding clean air to the ion modulating electrode, as means for further enhancing the effect of the present invention.

What is claimed is:

1. An image reproducing apparatus which comprises;
- a charge generator,
- an ion modulating electrode having at least a row of apertures for modulating ion flow generated by said charge generator,
- a charge receptor for reproducing an electrostatic image by the modulated ion flow, and
- a means for imparting oscillation to said ion modulating electrode.

2. An image reproducing apparatus according to claim 1, wherein said ion modulating electrode comprises a continuous layer of conductive material, a segmented layer of conductive material and an insulating layer, and said insulating layer is interposed between said continuous layer and said segmented layer.

3. An image reproducing apparatus according to claim 1, wherein said electrostatic image is an electrostatic latent image.

4. An image reproducing apparatus according to claim 1, wherein said charge receptor is a dielectric member.

5. An image reproducing apparatus according to claim 4, wherein said dielectric member comprises a dielectric layer and a conductive support.

6. An image reproducing apparatus according to claim 1, wherein said means for imparting oscillation consist of a rotor and an oscillation receiving plate applied with oscillation due to rotation of the rotor.

7. An image reproducing apparatus according to claim 1, wherein said means for imparting oscillation consist of a cam and an oscillation receiving plate applied with oscillation due to rotation of the cam.

8. An image reproducing apparatus according to claim 1, wherein said means for imparting oscillation consist of a permanent magnet, a coil placed in a magnetic field generated by the permanent magnet, an oscillator for allowing an alternating current to flow through the coil and an oscillation element connected to the coil.

* * * * *